US007322261B2

(12) United States Patent
Hu

(10) Patent No.: US 7,322,261 B2
(45) Date of Patent: Jan. 29, 2008

(54) METHOD FOR MANUFACTURING WRENCH HANDLE WITH PRESSED INDENTATION SECTION

(76) Inventor: Bobby Hu, 8F, No. 536-1, Ta Chin Street, Taichung (TW)

( * ) Notice: Subject to any disclaimer, the term of this patent is extended or adjusted under 35 U.S.C. 154(b) by 0 days.

(21) Appl. No.: 11/554,822

(22) Filed: Oct. 31, 2006

(65) Prior Publication Data

US 2007/0107552 A1 May 17, 2007

(30) Foreign Application Priority Data

Nov. 11, 2005 (TW) ..... 94139636 A
Jan. 17, 2006 (TW) ..... 95101812 A

(51) Int. Cl.
*B21K 5/16* (2006.01)
*B25B 13/00* (2006.01)

(52) U.S. Cl. ..... 76/10; 81/124.4; 81/900

(58) Field of Classification Search ..... 76/10; 81/124.4, 900
See application file for complete search history.

(56) References Cited

U.S. PATENT DOCUMENTS 5,448,932 A * 9/1995 Zurbuchen et al. ..... 81/124.4
6,855,217 B2 * 2/2005 Suzuki ..... 148/567

* cited by examiner

*Primary Examiner*—Joseph J. Hail, III
*Assistant Examiner*—Shantese McDonald
(74) *Attorney, Agent, or Firm*—Alan Kamrath; Kamrath & Associates PA

(57) ABSTRACT

A method for manufacturing a wrench handle includes preheating a work piece made of metal, with a layer of carbon scale being generated on the work piece during preheating. The preheated work piece is forged/pressed to form a wrench handle, with the carbon scale on the work piece being forged into upper and lower faces of the wrench handle. An indentation is formed on each of the upper and lower faces of the wrench handle. The carbon scale is then removed, leaving pits in the upper and lower faces of the wrench handle, with the pits concealed by the indentation sections.

8 Claims, 15 Drawing Sheets

METHOD FOR MANUFACTURING WRENCH HANDLE WITH PRESSED INDENTATION SECTION

BACKGROUND OF THE INVENTION

1. Field of the Invention

The present invention relates to a method for manufacturing a wrench handle with a pressed indentation section.

2. Description of the Related Art

FIG. 1 illustrates a conventional method for manufacturing a hand tool body such as a wrench body. The method comprises preheating a work piece and forging the work piece to form a wrench body. A layer of carbon scale is generated on the work piece during preheating. Referring to FIG. 2, the carbon scale 3 is forged into a surface 2 of the wrench body 1 during forging. Hence, surface cleaning is required after forging. Typically, the carbon scale 3 is removed by sand-blasting or tumbling. A plurality of pits 4 are left in the surface 2 of the wrench body 1 after surface cleaning, as shown in FIG. 3. As a result, further processing including grinding and subsequent heat treatment, polishing, and/or electroplating is required to provide a smooth surface for the purposes of attracting potential customers. However, the wrench body 1 includes arcuate portions that can only be manually ground, leading to an increase in the cost as well as poor qualified product ratio.

SUMMARY OF THE INVENTION

In accordance with an aspect of the present invention, a method for manufacturing a wrench handle in accordance with the present invention comprises preheating a work piece made of metal, with a layer of carbon scale being generated on the work piece during preheating; simultaneously forging and pressing the work piece after preheating to form a wrench handle having upper and lower faces and at least one end for driving fasteners, with the carbon scale on the work piece being forged/pressed into the upper and lower faces of the wrench handle, with an indentation section being formed on each of the upper and lower faces of the wrench handle, with each indentation section including a first level area having a first depth to an associated one of the upper and lower faces of the wrench handle, with the indentation section further including a second level area located at a position different from that of the first level area and having a second depth to the associated one of the upper and lower faces of the wrench handle, with the second depth being larger than the first depth; and removing the carbon scale after forging/pressing and leaving a plurality of pits in the upper and lower faces of the wrench handle, with each of the plurality of pits having a third depth to an associated one of the upper and lower faces of the wrench handle, with the third depth being larger than the first depth and smaller than the second depth, and with the plurality of pits being concealed by the indentation areas.

At least a portion of the layer of carbon scale may be removed before forging/pressing.

The carbon scale may be removed by sand-blasting or tumbling.

Preferably, pressing the work piece comprises pressing with a force of at least ten tons to form the indentation section on each of the upper and lower faces of the wrench handle.

Preferably, pressing/forging the work piece comprises forming at least one size-indicating area 28 on at least one of the upper and lower faces of the wrench handle.

In accordance with a second aspect of the present invention, a method for manufacturing a wrench handle comprises preheating a work piece made of metal, with a layer of carbon scale being generated on the work piece during preheating; simultaneously forging and pressing the work piece after preheating to form a wrench handle having upper and lower faces and at least one end for driving fasteners, with the carbon scale on the work piece being forged/pressed into the upper and lower faces of the wrench handle, with an indentation section being formed on each of the upper and lower faces of the wrench handle; and removing the carbon scale after forging/pressing and leaving a plurality of pits in the upper and lower faces of the wrench handle, with the plurality of pits being concealed by the indentation areas.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
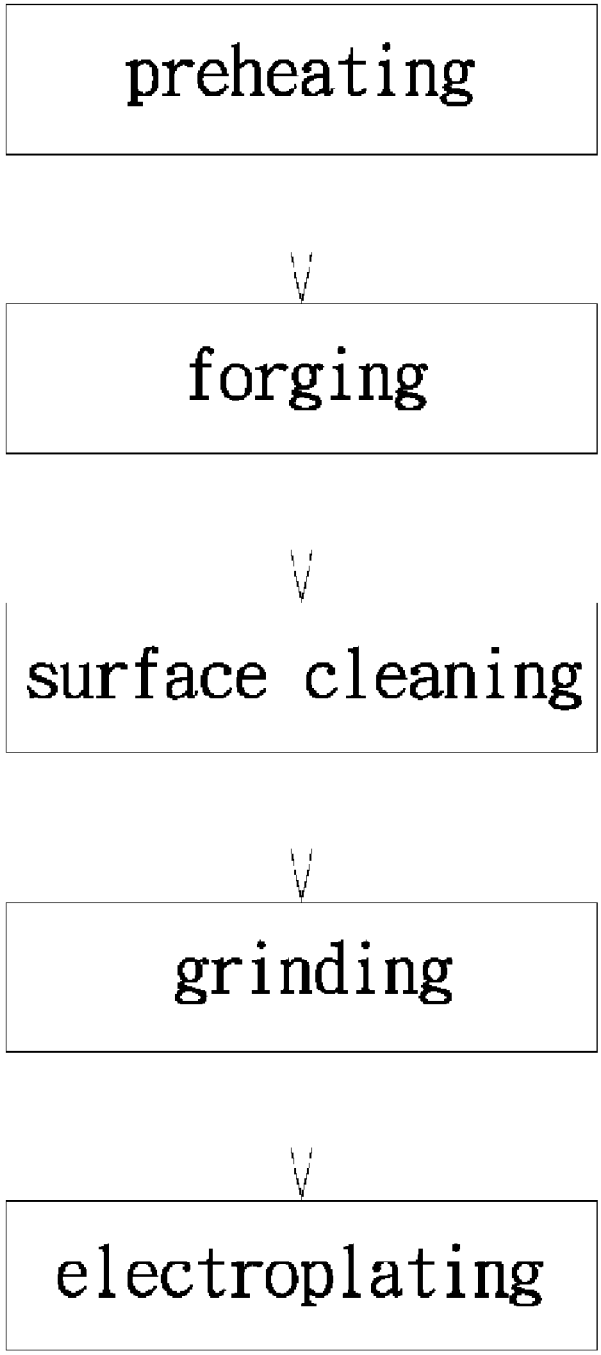
Fig. 1 PRIOR ART
FIG. 1 is a block diagram illustrating steps of a conventional method for manufacturing a wrench body.
Figure 2:
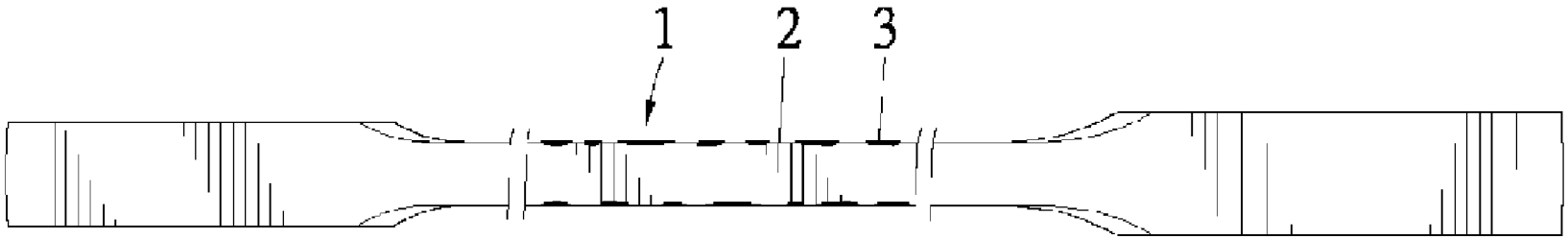
Fig. 2 PRIOR ART
FIG. 2 is a schematic side view illustrating a wrench handle after a forging step of the conventional method.
Figure 3:
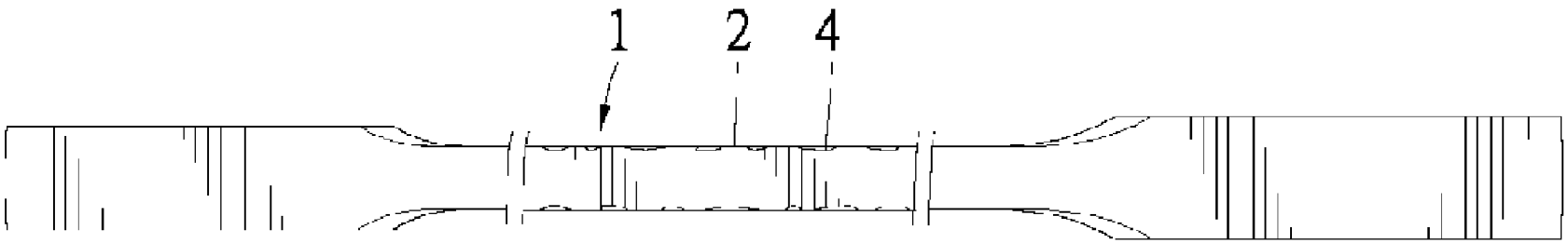
Fig. 3 PRIOR ART
FIG. 3 is a schematic side view illustrating a wrench handle after a surface cleaning step of the conventional method.
Figure 4:
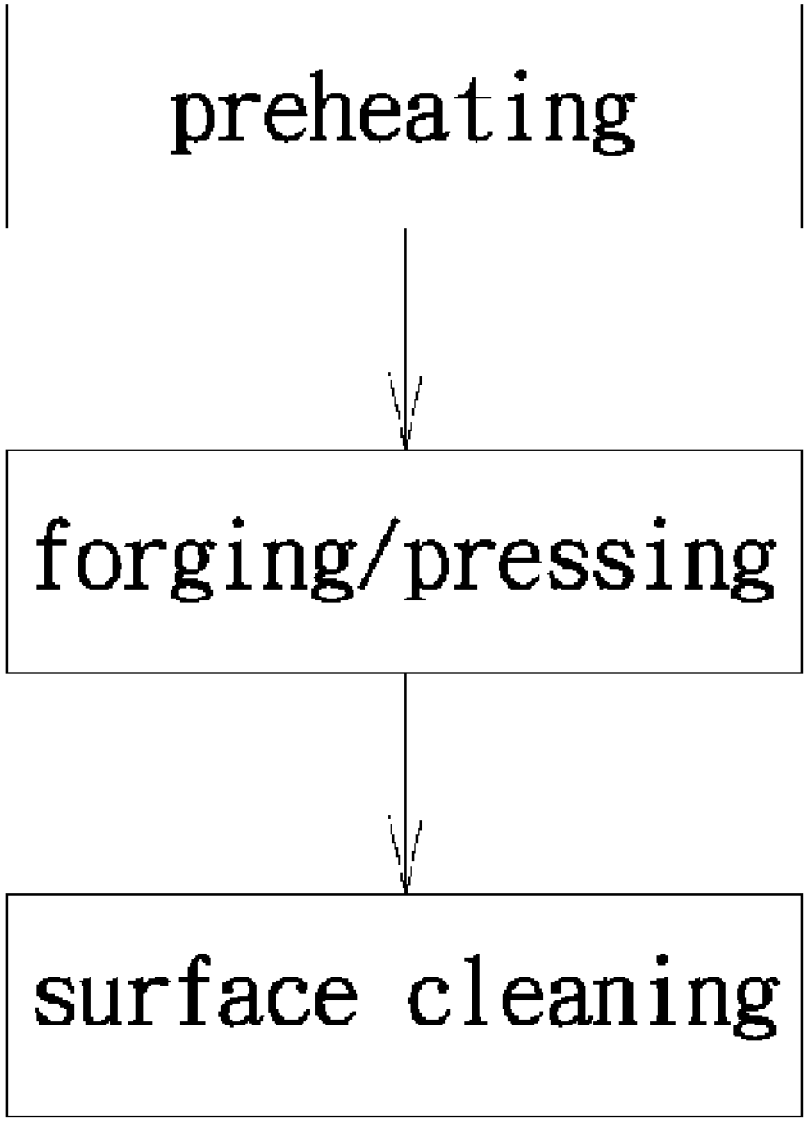
FIG. 4 is a block diagram illustrating a method for manufacturing a wrench handle accordance with the present invention.

Referring to FIG. 4, a method for manufacturing a wrench handle in accordance with the present invention comprises preheating, forging/pressing, and surface cleaning (removing carbon scale).

Figure 5:
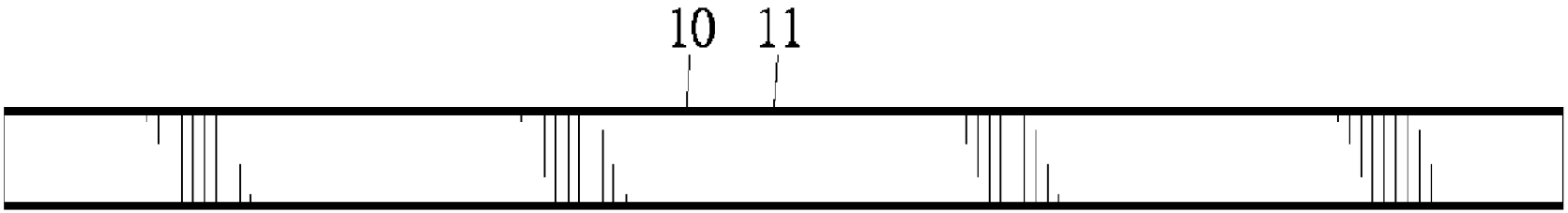
FIG. 5 is a schematic view illustrating a work piece after a preheating step of the method in accordance with the present invention.
Figure 12:
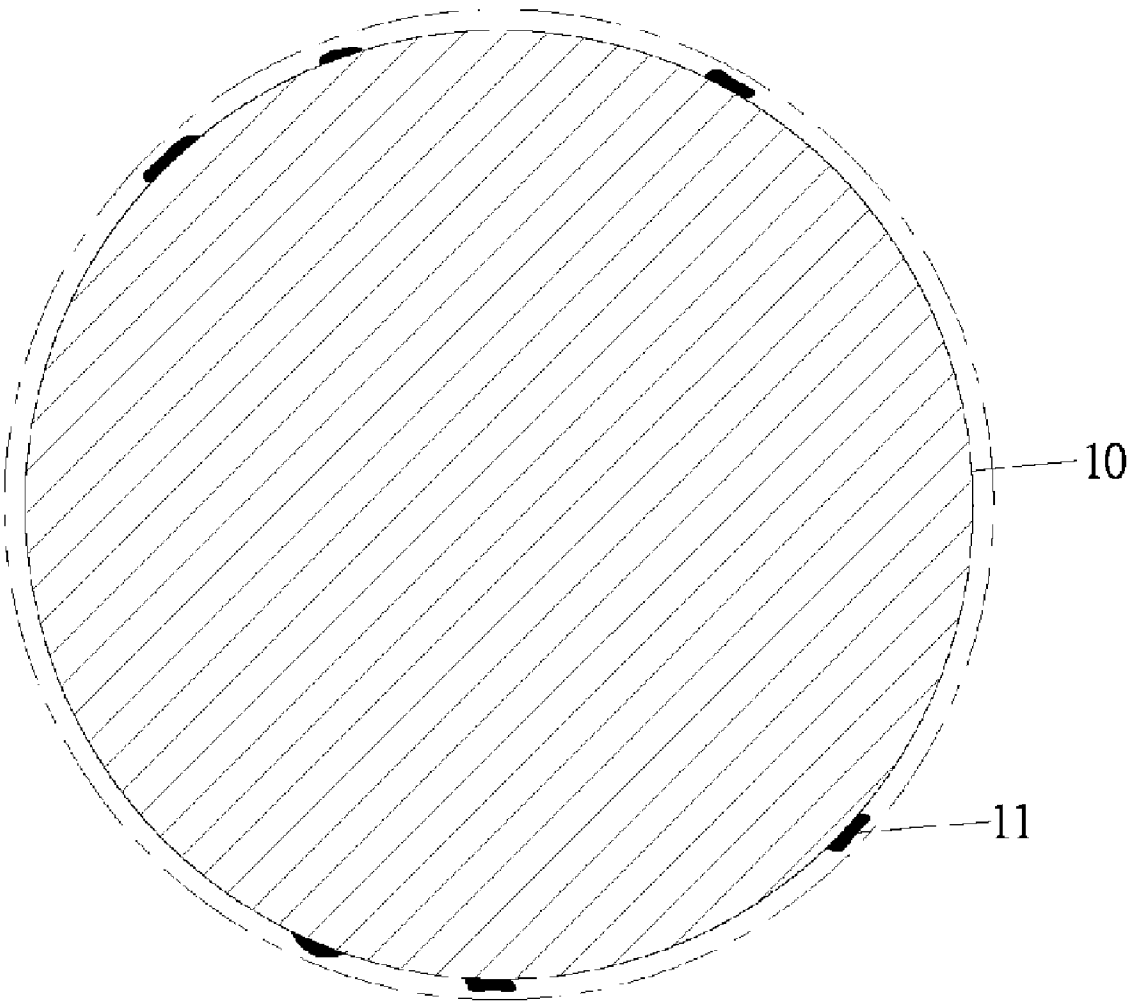
FIG. 12 is a schematic cross-sectional view of a work piece after preheating and before forging/pressing.

More specifically, in the first step of the method, a work piece 10 made of metal is preheated to prevent the work piece 10 from breaking during the subsequent forging/pressing procedure. A layer of carbon scale 11 is generated on a surface of the work piece 10, as shown in FIGS. 5 and 12. The depth of the layer of carbon scale is determined by the temperature of the preheating. Higher preheating temperatures will leave a thicker layer of carbon scale, while lower temperatures will leave a thinner layer of carbon scale. During preheating, the carbon scale 11 falls from the surface of the work piece 10, and new carbon scale 11 is generated on the surface of the work piece 10.

The work piece 10 is then forged/pressed to form a wrench handle 20. Namely, the work piece 10 is pressed while being forged. The wrench handle 20 in this example includes upper and lower faces 21 and two end portions 25 and 26. At least one of the end portions 25 and 26 is configured or subsequently processed to have structure for engaging with a fastener, a socket, an adapter, etc. It is noted that some of the carbon scale 11 falls off from the surface of the work piece 10 before the forging/pressing step (see FIG. 12) and that the carbon scale 11 is not completely removed after forging. More specifically, the remaining carbon scale 11 is forged/pressed into the upper and lower faces 21 of the wrench handle 20, as shown in FIGS. 6, 7, and 13.

Figure 6:
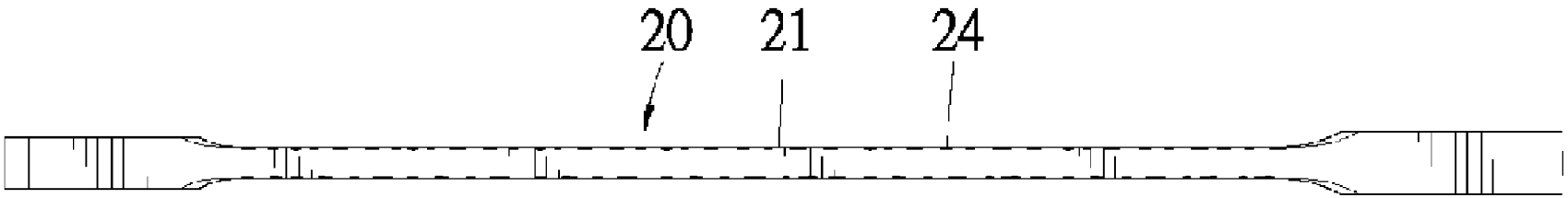
FIG. 6 is a schematic side view illustrating a wrench handle after a forging/pressing step of the method in accordance with the present invention.
Figure 7:
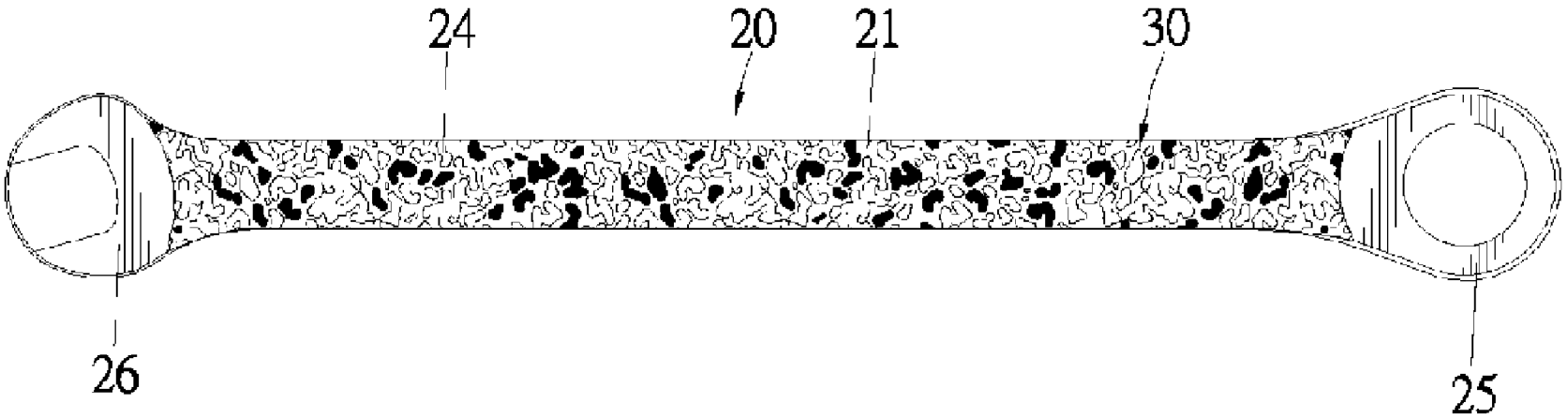
FIG. 7 is a schematic top view of the wrench handle in FIG. 6.
Figure 13:
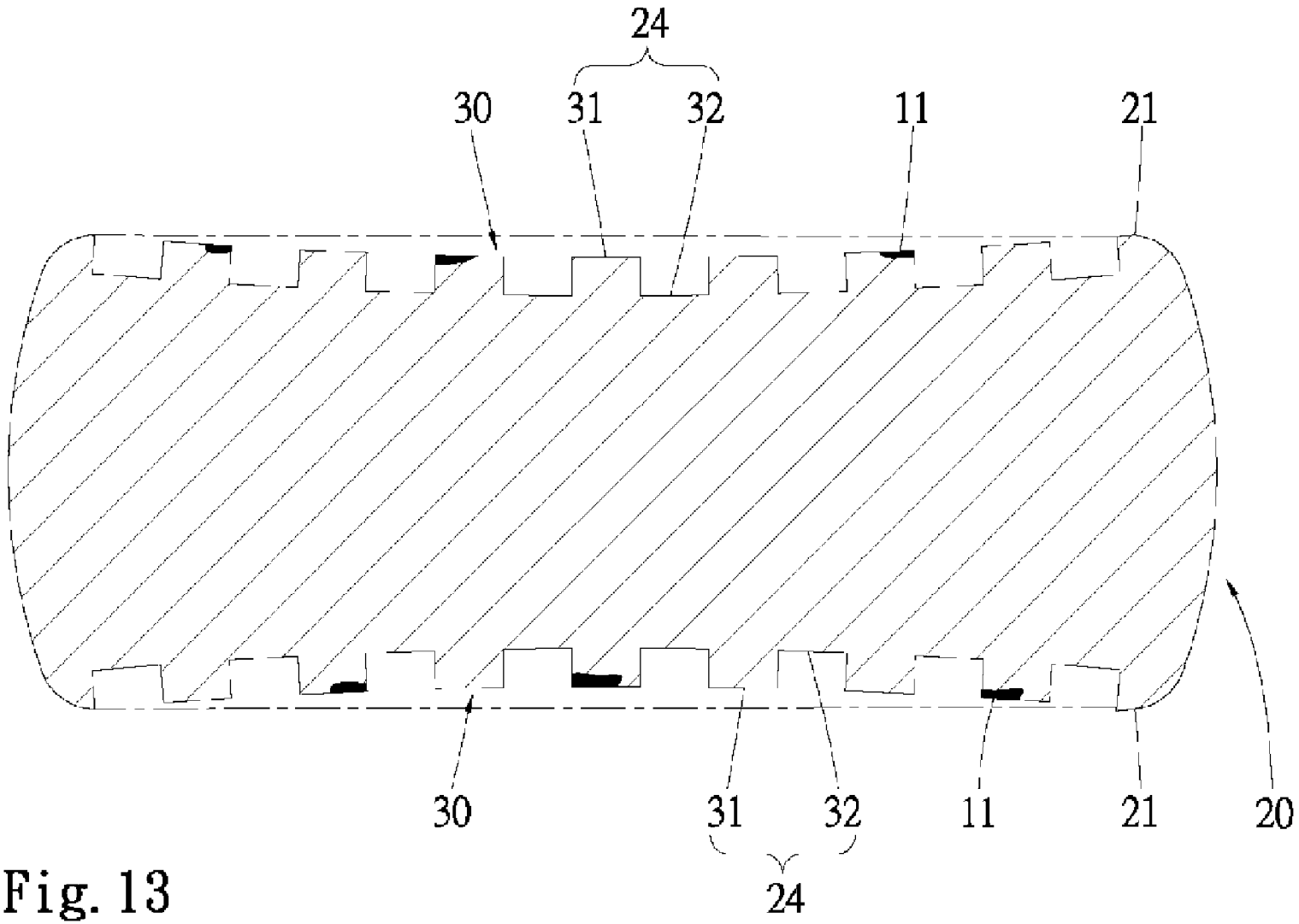
FIG. 13 is a schematic cross-sectional view of a wrench handle after forging/pressing.

Further, after forging/pressing, an indentation section 30 including a plurality of regular or irregular patterns 24 is formed on each of the upper and lower faces 21 of the wrench handle 20, as shown in FIGS. 6, 7, and 13. Preferably, the wrench handle 20 is pressed by a press (not shown) with a force of at least ten tons when forming the indentation section 30 on the wrench handle 20.

Figure 8:
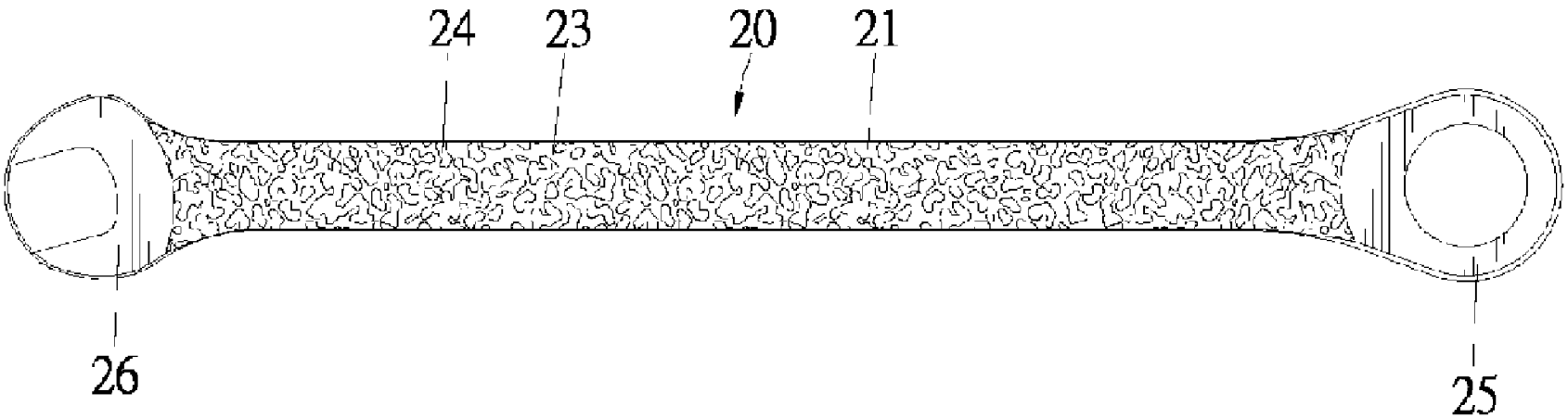
FIG. 8 is a schematic side view illustrating the wrench handle after a surface cleaning step of the method in accordance with the present invention.
Figure 14:
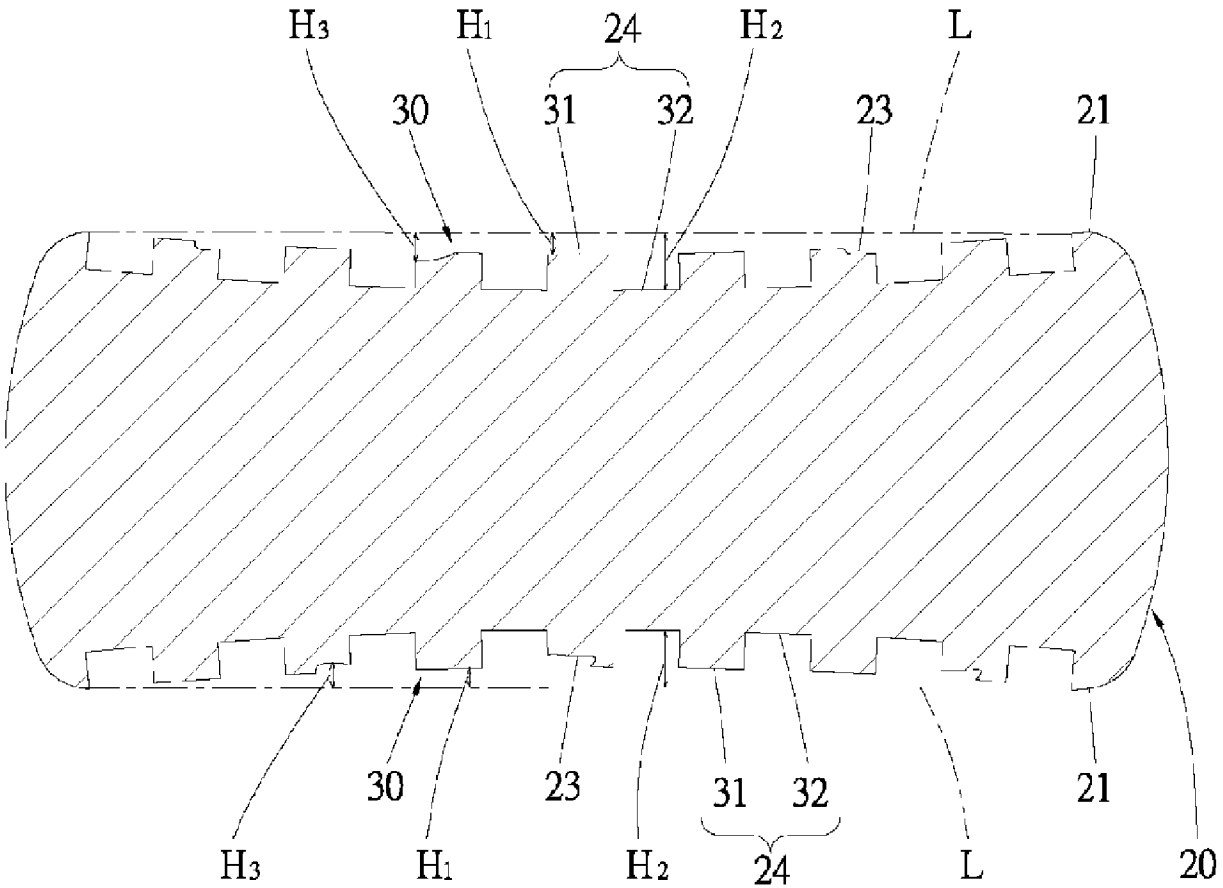
FIG. 14 is a schematic cross-sectional view of a wrench handle after surface cleaning.

Then, a surface cleaning process such as sand-blasting, tumbling, etc is carried out on the wrench handle 20 for removing the carbon scale 11. A plurality of pits 23 are left in the upper and lower faces 21 of the wrench handle 20 after the surface cleaning process, as shown in FIGS. 8 and 14. The patterns 24 conceal the pits 23 in the upper and lower surfaces 21 of the wrench handle 20. Namely, an observer cannot perceive the pits 23 with the naked eye. Nevertheless, the pits 23 may be observed with a magnifier or the like.

FIG. 14 shows the respective heights (depths) of upper and lower areas 31 and 32 of the indentation sections 30 and the pits 23. The pits 23 are shown for reference only, they are not readily visible in the indentation section 30. More specifically, each indentation section 30 includes a first level area 31 having a first depth H1 to the associated upper or lower face (see the line L) 21 of the wrench handle 20 after forging/pressing. Each indentation section 30 further includes a second level area 32 located at a position different from that of the first level area 31 and having a second depth H2 to the associated upper or lower face 21 of the wrench handle 20 after forging/pressing. The second depth H2 is larger than the first depth H1. After forging/pressing and surface cleaning, the depth H3 of each pit 23 to the associated upper or lower face 21 of the wrench handle 20 is larger than the first depth H1 and smaller than the second depth H2.

Figure 9:
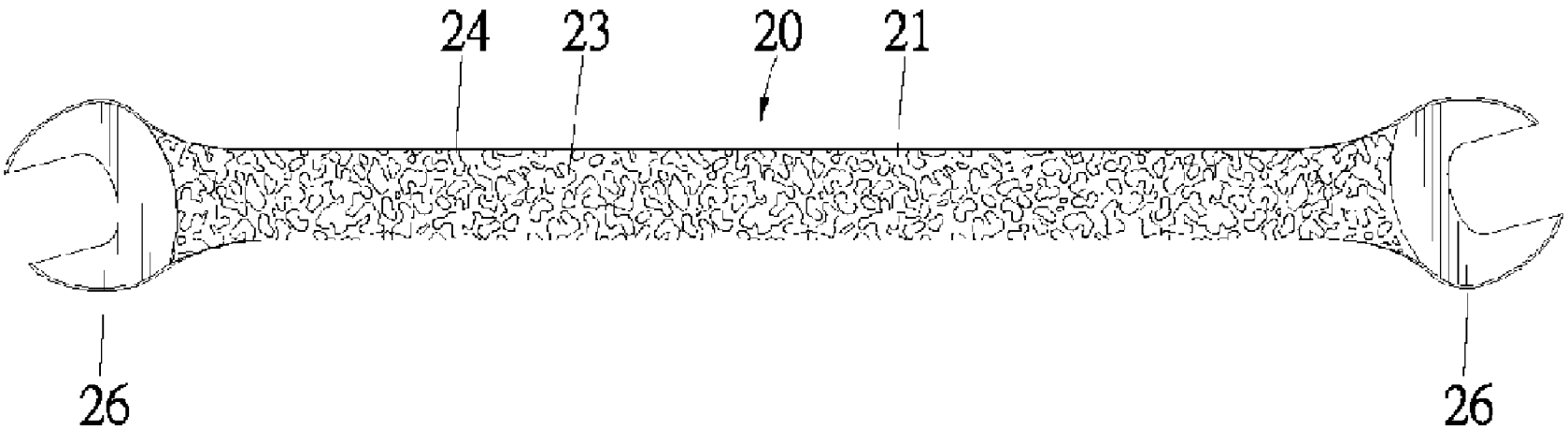
FIG. 9 is a schematic top view of another example of the final product produced by the method in accordance with the present invention.
Figure 10:
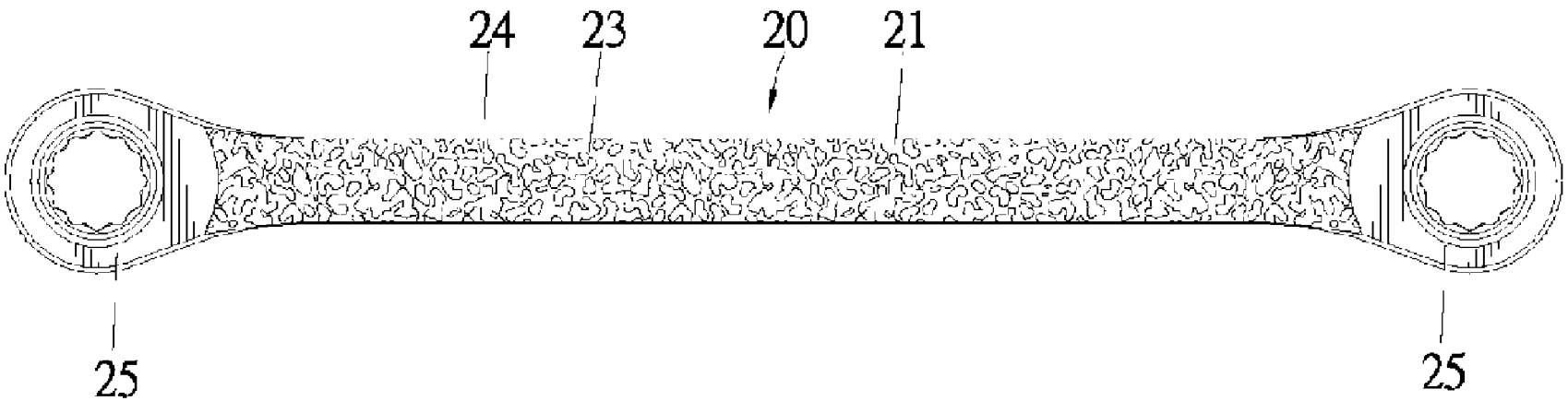
FIG. 10 is a schematic top view of a further example of the final product in accordance with the present invention.
Figure 11:
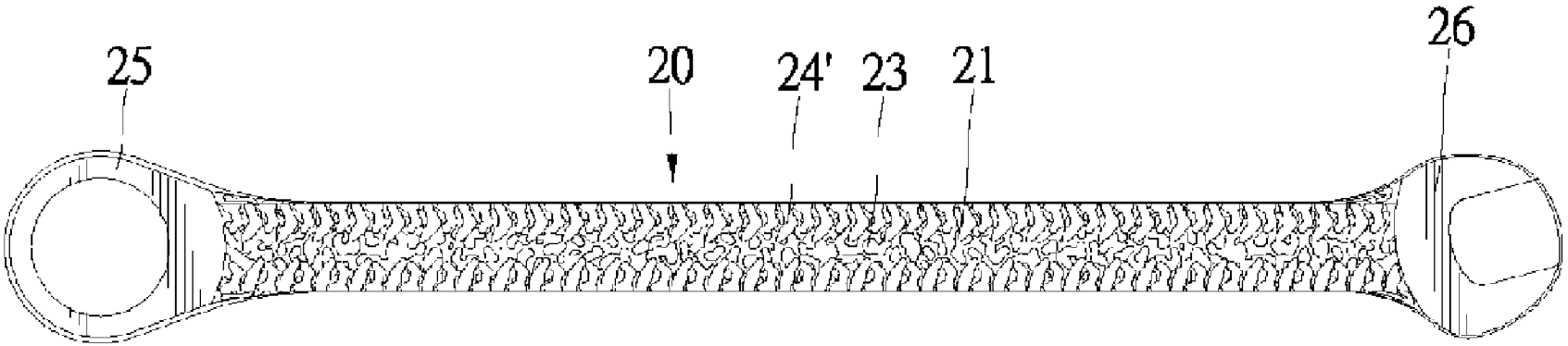
FIG. 11 is a schematic top view of still another example of the final product produced by the method in accordance with the present invention.

FIGS. 9 and 10 show different final products of the wrenches manufactured by the method in accordance with the present invention. It is noted that the end portions 26 in FIG. 9 have openings whereas the end portions 25 in FIG. 10 are box ends. It is further noted that the patterns 24 may have regular or irregular shapes. Further, the patterns 24 may be regularly or irregularly distributed on the surface 21 of the wrench handle 20. In the examples shown in FIGS. 8-10, the patterns 24 are irregular. In an alternative example shown in FIG. 11, the patterns 24' are regular.

Figure 15:
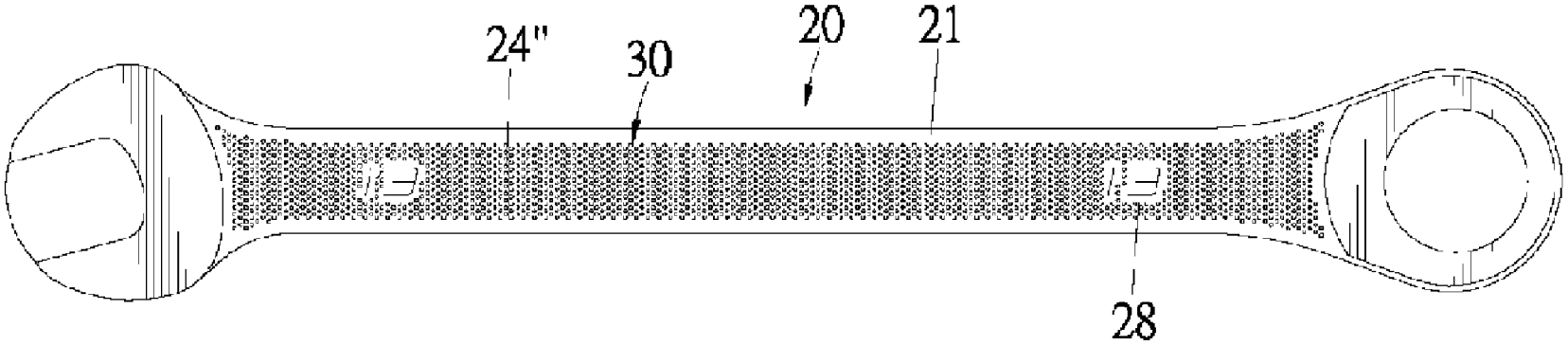
FIG. 15 is a schematic top view of yet another example of the final product produced by the method in accordance with the present invention.

FIG. 15 illustrates another final product produced by the method in accordance with the present invention. In this example, the patterns 24" of the indentation section 30 include a plurality of spaced circular protrusions (not labeled). Further, the indentation section 30 includes at least one size-indicating area 28 having a figure to indicate the size of the wrench. More specifically, at least one size-indicating area 28 is formed on at least one of the indentation sections 30 of the upper and lower faces 21 of the wrench handle 20.

At least a portion of the layer of carbon scale 11 may be removed before forging/pressing.

A wrench handle 20 manufactured by the method in accordance with the present invention is low in cost and has a high qualified product ratio, as manual grinding is not required and as only three steps are required. Further, the patterns 24, 24', 24" provide an aesthetically pleasing effect while effectively concealing the pits 23 resulting from removal of the carbon scale 11. Thus, the final wrench products are more attractive to the potential customers. Further, the patterns 24, 24' provide friction for the user's hand, providing an anti-slip effect.

Although specific embodiments have been illustrated and described, numerous modifications and variations are still possible without departing from the essence of the invention. The scope of the invention is limited by the accompanying claims.

What is claimed is:

1. A method for manufacturing a wrench handle, the method comprising:

preheating a work piece made of metal, with a layer of carbon scale being generated on the work piece during preheating;

simultaneously forging and pressing the work piece after preheating to form a wrench handle having upper and lower faces and at least one end for driving fasteners, with the carbon scale on the work piece being forged/pressed into the upper and lower faces of the wrench handle, with an indentation section being formed on each of the upper and lower faces of the wrench handle, with each said indentation section including a first level area having a first depth to an associated one of the upper and lower faces of the wrench handle, with the indentation section further including a second level area located at a position different from that of the first level area and having a second depth to the associated one of the upper and lower faces of the wrench handle, with the second depth being larger than the first depth; and removing the carbon scale after forging/pressing and leaving a plurality of pits in the upper and lower faces of the wrench handle, with each of the plurality of pits having a third depth to an associated one of the upper and lower faces of the wrench handle, with the third depth being larger than the first depth and smaller than the second depth, and with the plurality of pits being concealed by the indentation areas.

2. The method as claimed in claim 1 further comprising removing at least a portion of the layer of carbon scale before forging/pressing.

3. The method as claimed in claim 1 wherein removing the carbon scale includes sand-blasting or tumbling.

4. The method as claimed in claim 1 wherein pressing the work piece comprises pressing with a force of at least ten tons to form the indentation section on each of the upper and lower faces of the wrench handle.

5. The method as claimed in claim 1 wherein pressing/forging the work piece comprises forming at least one size-indicating area on at least one of the indentation sections of the upper and lower faces of the wrench handle.

6. A method for manufacturing a wrench handle, the method comprising:

preheating a work piece made of metal, with a layer of carbon scale being generated on the work piece during preheating;

simultaneously forging and pressing the work piece after preheating to form a wrench handle having upper and lower faces and at least one end for driving fasteners, with the carbon scale on the work piece being forged/pressed into the upper and lower faces of the wrench handle, with an indentation section being formed on each of the upper and lower faces of the wrench handle; and removing the carbon scale after forging/pressing and leaving a plurality of pits in the upper and lower faces of the wrench handle, with the plurality of pits being concealed by the indentation areas.

7. The method as claimed in claim 6 wherein pressing the work piece comprises pressing with a force of at least ten tons to form the indentation section on each of the upper and lower faces of the wrench handle.

8. The method as claimed in claim 6 wherein pressing/forging the work piece comprises forming at least one size-indicating area on at least one of the upper and lower faces of the wrench handle.

* * * * *